US005150100A

United States Patent [19]

Black et al.

[11] Patent Number: 5,150,100

[45] Date of Patent: Sep. 22, 1992

[54] SECURITY SYSTEM

[75] Inventors: David G. Black, Scottdale; Edwin P. Wilson, Allison Park, both of Pa.

[73] Assignee: Minatronics Corporation, Pittsburgh, Pa.

[21] Appl. No.: 705,385

[22] Filed: May 23, 1991

[51] Int. Cl.[5] ..... G08B 13/18; H01J 5/16

[52] U.S. Cl. ..... 340/555; 250/227.11; 340/506; 340/521; 340/539

[58] Field of Search ..... 340/555, 541, 663, 521, 340/691, 539, 636, 556, 679, 627, 658, 825,58, 825.7, 506; 250/227.11, 227.14, 227.15

[56] References Cited

U.S. PATENT DOCUMENTS

| | | | |
|---|---|---|---|
| 4,342,988 | 8/1982 | Thompson et al. | 340/679 |
| 4,468,657 | 8/1984 | Rossin | 340/555 |
| 4,764,758 | 8/1988 | Skala | 340/627 |
| 4,785,295 | 11/1988 | Fukui et al. | 340/679 |
| 4,818,970 | 4/1989 | Natale et al. | 340/539 |

*Primary Examiner*—Jin F. Ng
*Assistant Examiner*—Thomas J. Mullen, Jr.
*Attorney, Agent, or Firm*—Ansel M. Schwartz

[57] ABSTRACT

A security system for monitoring comprising an optical source for producing optical signals. The security system is also comprised of a detector in optical communication with the optical source which receives the optical signals produced by the optical source. The security system additionally is comprised of an electrical circuit in communication with the optical source and the detector, which is either in a first state or a second state. The circuit controls the optical source and determines whether the optical signal received by the detector is such that the circuit is in the first state or the second state. The circuit also indicates when the optical signal received by the detector is such that a transition from the first state to the second state is imminent to occur. The presence of this imminent transition is otherwise called the pre-alarm condition. In a preferred embodiment, the circuit includes multiple status circuit sensor outputs which inform the local and remote locations about the status of the distinct operating conditions of the circuit.

13 Claims, 3 Drawing Sheets

SECURITY SYSTEM

FIELD OF THE INVENTION

The present invention pertains to a security system. More specifically, the present invention pertains to a security system which has environmental sensing and pre-alarm conditions.

BACKGROUND OF THE INVENTION

A common problem in all security systems is to ensure that a real alarm condition and not a false alarm condition exists. A false alarm condition can result from many aspects of security system environmental conditions and should be identified by the system. A false alarm condition can occur by an authorized person accidentally triggering a sensor that indicates something is amiss, or, for instance, a battery power falling below a desired level resulting in a false alarm being triggered.

Security systems that utilize an optical fiber which is extended through objects desired to be protected must ensure that the optical fiber is not too long. If it is too long, the optical signal passing therethrough becomes too attenuated to properly alert the system if the optical fiber is intact. Alternatively, when remote locations monitor given secured locations, the remote location desires to have information about the secured location. For instance, the remote location monitoring a specific secured site may want to be kept abreast of the power level available to the secured site, or if any unusual contact is occurring at the secured site (but which no alarm has yet triggered). Heretofore, such features have not been integrated into security system to assist a user or monitor in better understanding the status and condition of the system.

SUMMARY OF THE INVENTION

The present invention pertains to a security system for monitoring. The security system comprises an optical source for producing optical signals. The security system is also comprised of a detector in optical communication with the optical source which receives the optical signals produced by the optical source. The security system additionally is comprised of an electrical circuit in communication with the optical source and the detector, which is either in a first state or a second state. The circuit controls the optical source and determines whether the optical signal received by the detector is such that the circuit is in the first state or the second state. The circuit also indicates when the optical signal received by the detector is such that a transition from the first state to the second state is imminent to occur. The presence of this imminent transition is otherwise called the pre-alarm condition.

In a preferred embodiment, the circuit includes multiple status circuit sensor outputs which inform the local and remote locations about the status of the distinct operating conditions of the circuit.

BRIEF DESCRIPTION OF THE DRAWINGS

In the accompanying drawings, the preferred embodiment of the invention and preferred methods of practicing the invention are illustrated in which.

FIGS. *2a*, *2b* and *2c* are schematic representations of a circuit of the security system.

DESCRIPTION OF THE PREFERRED EMBODIMENT

Figure 1:
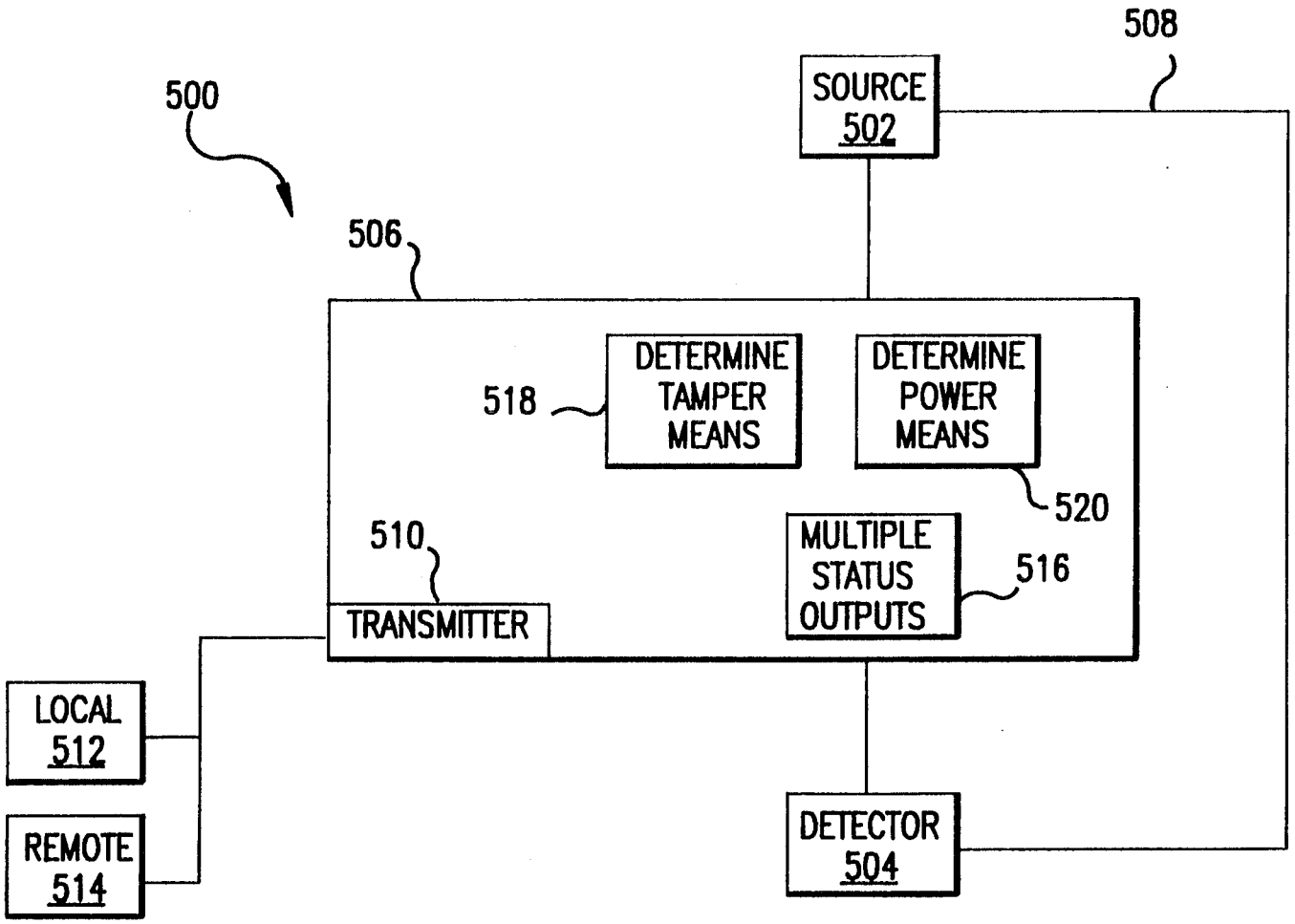
FIG. 1 is a block diagram of a security system.

Referring now to the drawings wherein like reference numerals refer to similar or identical parts throughout the several views, and more specifically to FIG. 1 thereof, there is shown a schematic representation of a security system 500. The security system 500 is comprised of an optical source 502 for producing optical signals. Additionally, the security system is comprised of a detector 504 in optical communication with the optical source 502 which receives the optical signals produced by the optical source 502. The security system 500 is also comprised of an electrical circuit 506 in communication with the optical source 502 and detector 504, which is either in a first state or a second state. The circuit 506 controls the optical source 502 and determines whether the optical signal received by the detector 502 is such that the circuit 506 is in the first state of the second state. The circuit 506 also indicates when the optical signal received by the detector 504 is such that a transition from the first state to the second state is imminent to occur. The presence of this imminent transition is otherwise called a pre-alarm condition.

Preferably, the system 500 includes an optical waveguide 508, such as an optical fiber, connected to the source 502 and detector 504 for transmitting the optical signal therebetween. The system 500 preferably also includes a transmitter 510 for communicating with a local location 512 or remote location 514 the state of the circuit 506.

Preferably, the circuit includes multiple state circuit sensor outputs 516 which inform the local locations 512 and remote locations 514 about the status of distinct operating conditions of the circuit 506. Additionally, the circuit 506 includes means 518 for determining whether the system 500 is being tampered with, and means 520 for determining whether the circuit has other than normal power provided to it.

In the operation of the preferred embodiment, and referring to FIGS. *2a* and *2b*, the first terminal 10 is connected to positive DC Voltage. A first LED 12 is a green power indicator LED, and has an associated dropping resistor 14 of 470 ohms. The first LED 12 indicates the presence of a DC operating voltage provided by a remote power supply. The purpose of a first diode 16, a 4001 diode, is to prevent leakage voltage from burning out the first LED 12 in the absence of transformer power.

A MOV 18, Metal Oxide Veristor, serves as a surge suppressor. A first IC 20, an LM317, is a voltage adjustable regulator. The unregulated voltage appearing at Pin 1 thereof is on the order of 12 volts, or even more depending on the transformer used. A second resistor 22 and a third resistor 24, being a 1K potentiometer and 150 ohms, respectively, form an adjustable network, that allows the operating voltage to be set and also the correct charging voltage for the battery.

A second diode 26, a 4001 diode, is used to prevent back leakage in current consumption. There is a gel cell battery 28 which is connected to a second terminal 30. The battery 28 is a 6 volt, 1 amp battery. The charging voltage is set with the second resistor 22 for the appropriate charging voltage for different sorts of batteries, mostly 6.8 is the desired voltage. The circuitry comprising a Zener diode 32 (3.9v), and two 914 diodes 34, a 470 ohm resistor 36, a 10K ohm resistor 38, a 10K ohm resistor 40, another 470 ohm resistor 42, a 2222 transistor and an MPSA63 transistor 46 forms a low battery shutdown. The purpose of this is, if the battery 28 were to be completely depleted, it would have permanent damage and may never recharge. So this circuit shuts off the battery 28 under such circumstances, eliminating the run down at approximately 4 volts. Therefore, the battery 28, being 6.8 volts, will only run down to 4 volts and then the load is eliminated.

Another 914 diode 48 is connected to the second terminal 30 and provides the battery voltage only to the 9 volt IT 60–104 transmitter. This is so the 9 volt transmitter does not lose its memory. It operates on only microamps so it is not a problem as far as depleting the Gel Cell battery 28. A first capacitor 50 which is connected to the output of the low voltage battery shutdown, in a 2200 microfarad filter capacitor. It serves to eliminate any ripple or bad transients on the DC operating voltage.

The 100K ohm resistor 52, 100K ohm resistor 54, 24 ohm resistor 56, second 0.01 MFD capacitor 58, third 0.01 MFD capacitor 60, fourth 100μ capacitor 62, fifth 0.001 capacitor 64, three 914 diodes 66, a 9.1 volt diode 68 and a 555 IC 70 together form a voltage doubler which takes the Gel battery output voltage, approximately 6 to 6.8 volts, and by the use of a multivibrator, generates an AC square wave, which is then rectified and filtered with diode 66*a* and associated circuitry to provide 9 volt operating voltage for the transmitter. The diode 68, diode 66*b* and resistor 56 regulate that voltage to approximately 9.2 volts. A third IC 72 and some of its components: a 10M resistor 74 and 1MFD capacitor 76 create the multivibrator which develops a very low duty cycle square wave that illuminates a third LED 78, an MFOE76, a Motorola device which is the fiber optic transmitting part of the circuit. That narrow pulse width is propelled through the fiber optic cable. LED 78 is connected to a 24 ohm dropping resistor 79.

A second LED 80 is an alarm indicator. If the circuit is not satisfied that the fiber optic loop is intact, it will light up, indicating that there is a violation of the protective loop. Also a unique feature of that is, if the fiber optic cable, which has considerable attenuation, and splices are a real problem as far as attenuation, or if the cable length is approaching the useful range of the circuit, the LED 80 will pulse, or flicker, giving an indication that the circuit is about to go into an alarm state, otherwise called the pre-alarm condition. Pin 1 of the IC 72 is strictly a DC operating bias adjustment.

A MFOD73 phototransistor 82 (connected to a 100K resistor 83) receives the pulse coming from the end of the fiber optic protective loop, and processes that as a received signal. A 0.01 coupling capacitor 84, couples that to a 2N5458 transistor 86 and all its associated components (a 470K resistor 88, 4.7K resistor 90, 1K resistor 92, 47μ capacitor 96, 1N914 diode 98, 180K resistor 100) the amplifier stage which can accommodate a very wide dynamic range from millivolts received at the end of very, very long length of cable, clear up to the full operating power supply of rail voltage, being 6 volts and yield a pulse output corresponding to the received signal.

A flip-flop inside the IC 72 compares the original transmitted signal to the received signal to make sure that it is a valid received signal. Transistor 102 (MDSA63) is a current buffer to supply enough operating current to satisfy the input on Pin 5 of IC72. Pin 6 of IC72 is the relay driver, or output of the IC72. If the loop is violated, this point will go to low, upon violation. 2N2222 transistor 102 connected to capacitor 104 (47μ), 10K resistor 106 and 1K resistor 108 form a voltage inverter, to satisfy future stages. Transistor 110 is a 2N5064 SCR, silicon control rectifier. Its associated circuitry, the capacitor 112 and 100K resistor 114 provide a DC pulse, which would be positive when alarm occurs; a one-shot pulse, to the gate of the SCR 110, which then latches on until manually reset. This is done with external circuitry or with the read switch 116 that is directly across the SCR 110 the node and the cathode. The purpose of the reed switch 116 is so, if you provide zero volt differential between the annode and the cathode, the SCR will commutate or return back to the nonconducting state. The output relay, K1, which is the ultimate interface to the outside world, is other transmitters, or other such items that would be attached to the interface. The 220K resistor 118 and the 100μ capacitor 120 provide an RC time constant, which does not allow K1 to energize for the initial several seconds. This is to prevent a false alarm upon the occurrence of a battery which has been completely depleted down to the low battery cutoff threshold having power being reapplied which would create a false alarm. That is the purpose of the MPSA 13 transistor 122 and associated components (100K resistor 124) for the RC time constant that eliminates that turn-on transient. The transistor 122 is a driver transistor which is in series with 2222 transistor 126 which gives the alarm output; once the IC 72 is committed, pin 6 goes low, which the inverter, transistor 102, then makes that go high at the collector. Then, 10K resistor 128 couples that high voltage, which causes transistor 122 to conduct and thus pull in the relay K1. S1 and S2, which are double pole, double throw tamper switches, are appropriately in series and parallel with the correct contacts of the relay K1. This allows the tamper feature to work even if the relay is inoperable due to low battery shutdown, or whatever else might arise. The case tamper is still going to provide an output to the transmitter which would signal an alarm condition. Tamper output 128 allows independent indication or reporting of a tamper condition. Output 128 and the transmitter together form multiple status circuit sensor outputs.

Figure 2A:
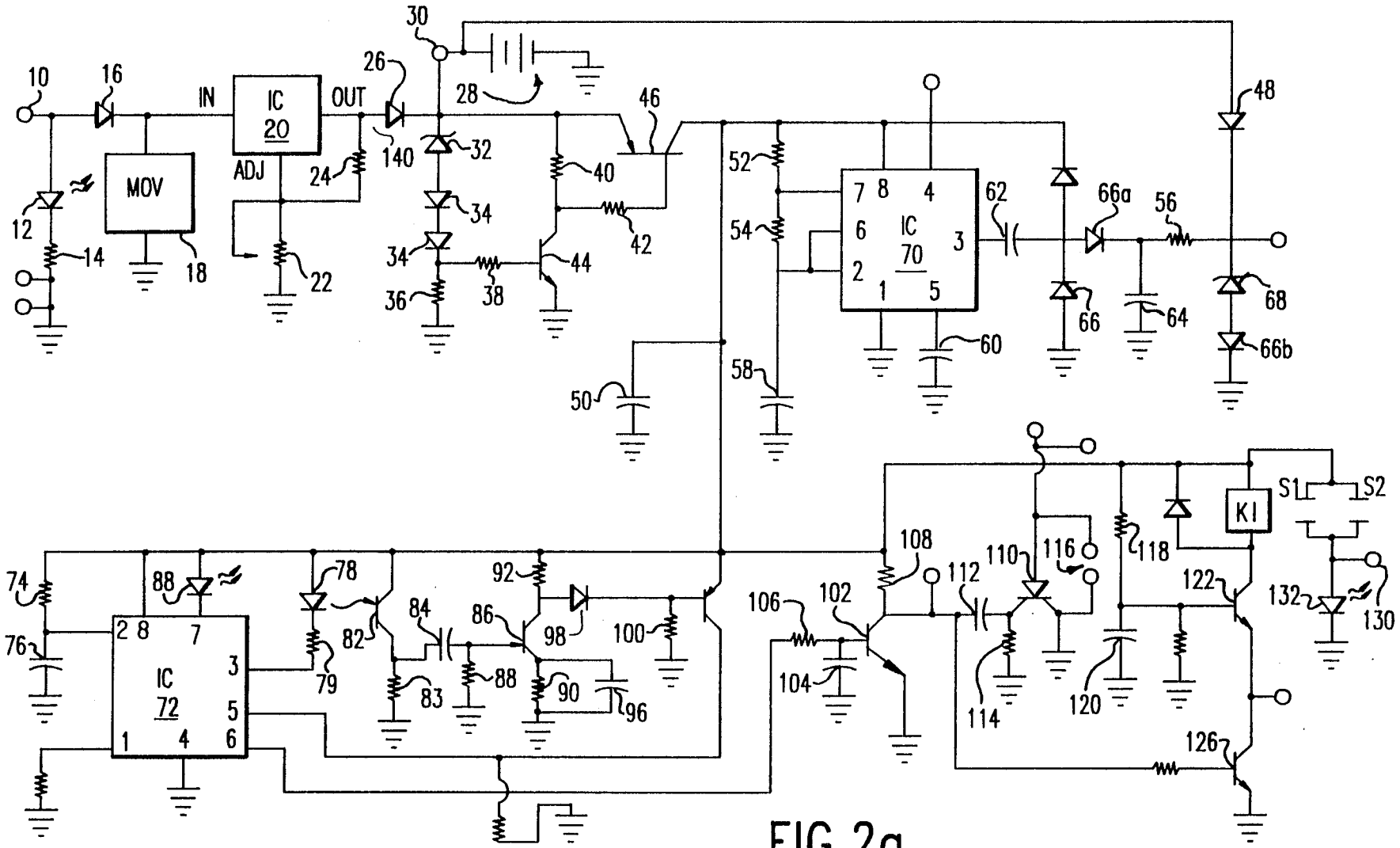
Figure 2B:
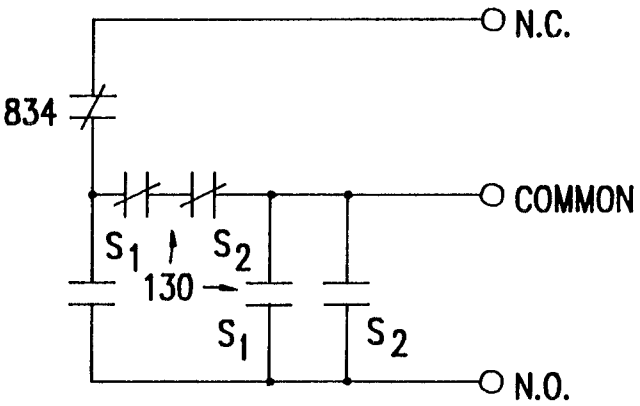

The means for determining whether the system is being tampered with is identified in FIG. 2*b*. The switches 130 are set such that when either the case in which the circuitry is disposed is removed, or the case is removed from the surface upon which it is mounted, the tamper condition occurs and a signal indicates the same locally by way of LED 132, output 128; and remotely by way of the transmitter. The transmitter relay 134 is connected to K1.

Figure 2C:
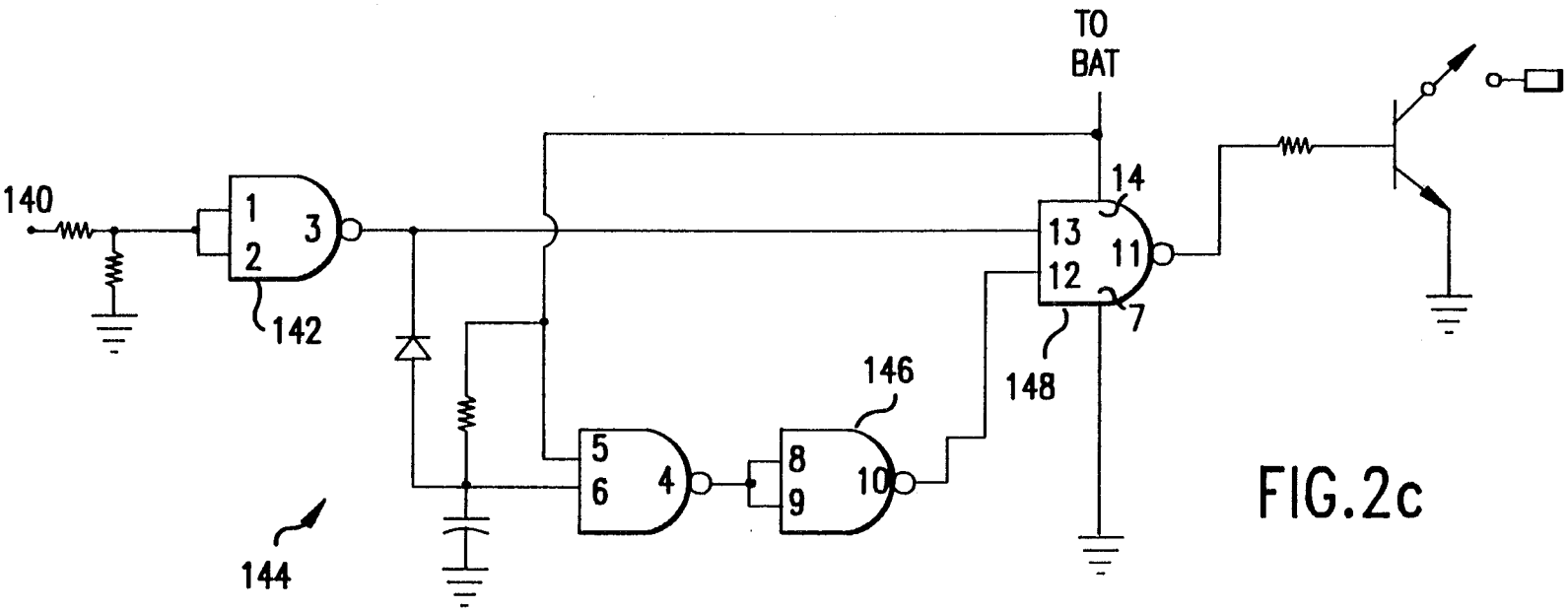

In addition, the pre-alarm condition can be provided to remote or local locations by way of the circuit shown in FIG. 2*c*. This is accomplished by sampling AC power at point 140. The same is provided to an inverter 142 and then to an RC timing circuit 144 which delays the signal enough to prevent momentary power outages from triggering an alarm. The signal is inverted again with inverter 146 and provided to a NAND gate 148 which determines whether there is a loss of AC power, and if so, then initiates an alarm. The transmitter to which it is connected sounds the sample.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A security system comprising:

an optical source for producing optical signals;

a detector in optical communication with the optical source which receives the optical signals produced by the optical source;

an optical waveguide connected to the source and detector for transmitting the optical signal therebetween;

an electrical circuit in communication with the optical source and the detector, having an alarm which is either in a first state when the optical signals received by the detector have not been attenuated beyond a predetermined limit or a second state when the optical signals received by the detector have been attenuated beyond the predetermined limit, said circuit controlling the optical source and determining whether the optical signal received by the detector is such that the alarm is in the first state or the second state, said circuit also having means for indicating if the optical signals passing through the waveguide have been attenuated due to the optical waveguide having too long a length such that a transition from the first state to the second state is imminent to occur, the presence of this imminent transition being a pre-alarm condition.

2. A system as described in claim 1 including a transmitter for communicating with a local or remote location the state of the circuit.

3. A system as described in claim 2 wherein said circuit includes multiple status circuit sensor outputs which inform said local or remote location about the status of distinct operating conditions of the circuit.

4. A system as described in claim 3 wherein the circuit includes means for determining whether the system is being tampered with, and means for determining whether the circuit has other than normal power provided to it; and wherein distinct conditions include the pre-alarm condition, a tamper condition and a weak power condition.

5. A security system as described in claim 1 wherein the indicating means shows the magnitude of attenuation.

6. A security system as described in claim 5 wherein the optical source produces a periodic optical pulse and the indicating means includes a synchronizer which compares the periodic optical pulse from the source with the periodic optical pulse received by the detector and having an output, a light emitting diode in communication with the output, a resistor/capacitor circuit in communication with the output and a transistor in communication with the resistor/capacitor circuit for placing the alarm in the second state.

7. A security system as described in claim 6 wherein the periodic optical pulse is a square wave.

8. A security system comprising:

an optical source for producing a periodic optical pulse;

a detector in optical communication with the optical source which receives the pulse;

an optical waveguide connected to the source and detector for transmitting the optical pulse therebetween;

an electrical circuit in communication with the optical source and detector having an alarm which is in a first state when the optical pulse received by the detector is not out of phase with the optical pulse from the source beyond a predetermined limit or a second state when the optical pulse received by the detector is out of phase with the optical pulse from the source beyond the predetermined limit, said circuit controlling the optical source and determining whether the optical pulse received by the detector is such that the alarm is in the second state or the first state, said circuit also having means for indicating phase differences between the optical pulse from the source and the optical pulse received by the detector which are not beyond said predetermined limit.

9. A security system as described in claim 8 wherein the indicating means includes a synchronizer which compares the optical pulse from the source with the optical pulse received by the detector and having an output, a light emitting diode in communication with the output, a resistor/capacitor circuit in communication with the output and a transistor in communication with the resistor/capacitor circuit for triggering the alarm.

10. A security system as described in claim 9 wherein the periodic optical pulse is a square wave.

11. A security system as described in claim 10 including a transmitter for communicating with a local or remote location the state of the circuit.

12. A system as described in claim 11 wherein said circuit includes multiple state circuit sensor outputs which inform said local or remote location about the status of distinct operating conditions of the circuit.

13. A system as described in claim 12 wherein the circuit includes means for determining whether the system is being tampered with, and means for determining whether the circuit has other than normal power provided to it; and wherein distinct conditions include the pre-alarm condition, a tamper condition and a weak power condition.

* * * * *